United States Patent [19]

Corn

[11] Patent Number: 4,591,055

[45] Date of Patent: May 27, 1986

[54] VACUUM PACKAGE FOR TRANSIT

[76] Inventor: Ronald J. Corn, 52 Blockland Dr., Longmeadow, Mass. 01106

[21] Appl. No.: 758,290

[22] Filed: Jul. 24, 1985

[51] Int. Cl.[4] ..... B65D 81/20; B65D 55/02

[52] U.S. Cl. ..... 206/459; 116/200; 116/215; 206/423; 206/524.8; 206/807; 220/231; 426/87; 426/404

[58] Field of Search ..... 116/200, 201, 215, 281; 206/459, 524.8, 807, 423; 220/209, 214, 231, 240; 229/4.5, 5.5; 426/87, 131, 404; 40/310, 311, 446, 486, 488

[56] References Cited

U.S. PATENT DOCUMENTS

| | | | |
|---|---|---|---|
| 2,870,954 | 1/1959 | Kulesza | 206/524.8 |
| 2,937,597 | 6/1960 | Greene | 116/200 |
| 3,026,656 | 3/1962 | Rumsey, Jr. | 206/524.8 |
| 3,198,163 | 8/1965 | Williams | 426/87 |
| 3,585,846 | 6/1971 | Broberg | 116/200 |
| 4,295,566 | 10/1981 | Vincek | 206/524.8 |
| 4,398,491 | 8/1983 | Fridl et al. | 206/459 |
| 4,436,203 | 3/1984 | Reyner | 206/524.8 |
| 4,466,553 | 8/1984 | Zenger | 206/524.8 |
| 4,471,900 | 9/1984 | Kadunce | 229/4.5 |
| 4,546,881 | 10/1985 | Tasma | 206/807 |

*Primary Examiner*—William Price
*Assistant Examiner*—Jimmy G. Foster
*Attorney, Agent, or Firm*—Leonard S. Michelman

[57] ABSTRACT

A package for preserving fresh fruits, meats, flowers and the like by vacuum packing same in a tubular shaped cylindrical type container.

The container is covered with a thermo, transparent, resilient, plastic material and sealed after the air is withdrawn. There is a signaling means for indicating whether the vacuum has been breached and air has entered into the chamber comprising of a green disc that falls away from a red spot whereby the red spot appears through an opening in the end plate.

There are end plates independent of the cylindrical chamber and secured to same for convenience in storage and safety in transit. The end plates have a flat surface of sufficient area so as to act as support members and are secured at each end of the cylindrical container so as to form a unitary package.

10 Claims, 11 Drawing Figures

FIG. 1
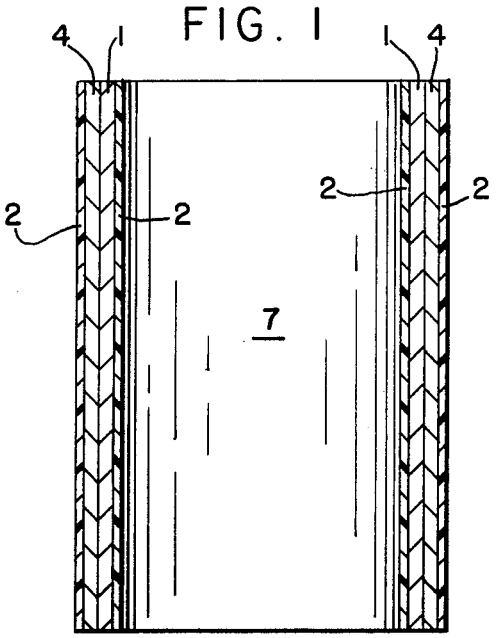
FIG. 2
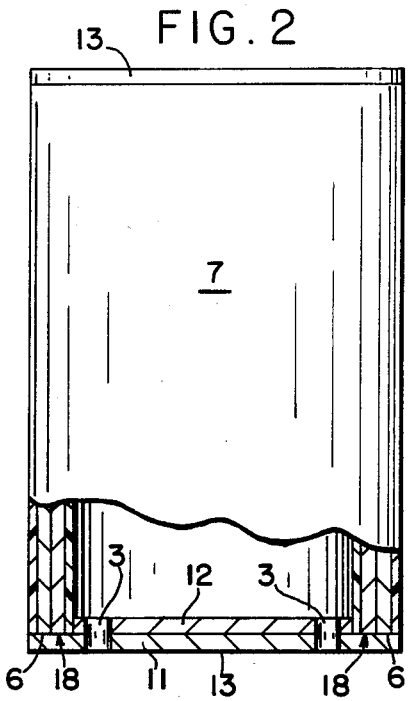
FIG. 3
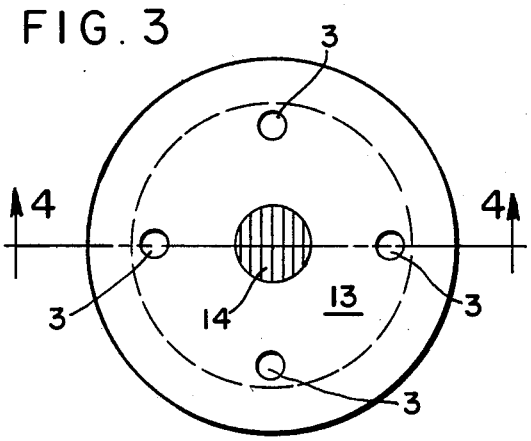
FIG. 5
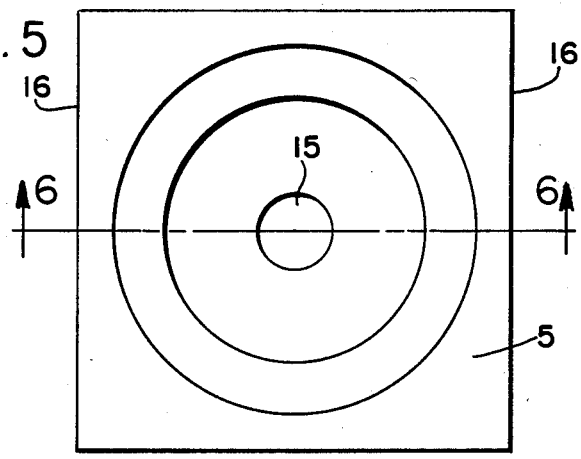
FIG. 4
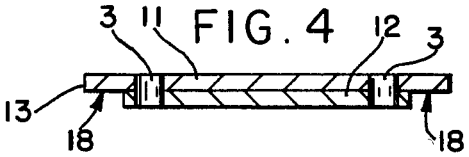
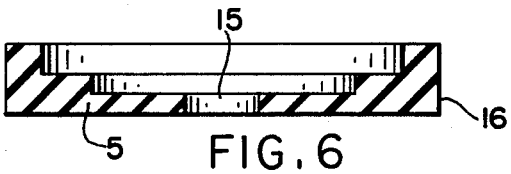
FIG. 6
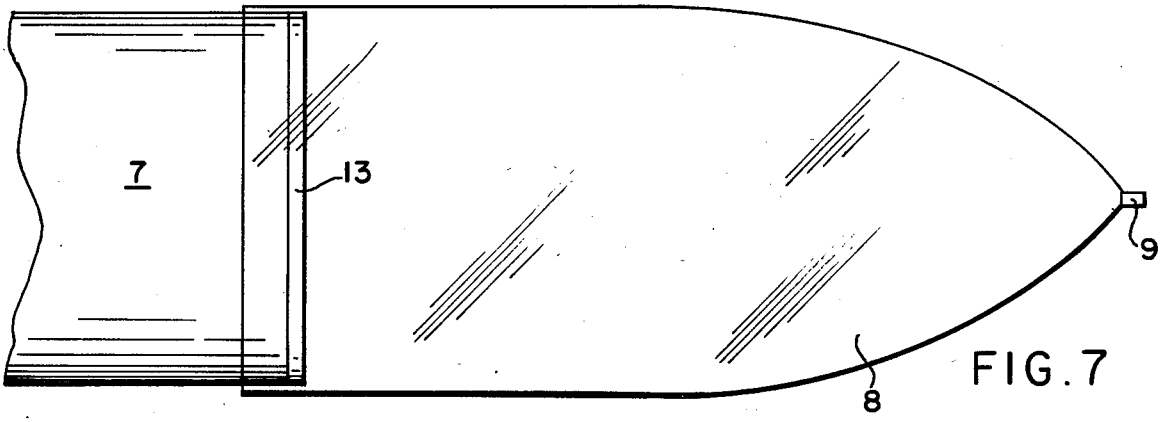
FIG. 7

VACUUM PACKAGE FOR TRANSIT

BACKGROUND OF THE INVENTION

1. Field of the Invention

The present invention relates to the technology of packaging vacuum sealed contents. Instead of freezing vegetables and meats, attempts have been made to vacuum seal perishable items and ship them in the vacuum pack so that they can be stored for long periods of time without deterioration.

The packaging of the perishable type of produce and meats that is taught by the novel package of this invention, is a relatively new art and technology. There have been attempts by some prior patents to solve the problem preventing the vacuum from causing pressure on the contents such as the produce or meat during the act of the drawing off of the air during the creation of the vacuum and destroying their marketability. This invention is a solution to that problem.

2. Description of the Prior Art

In the prior art, various attempts have been made to manufacture a type of package that will carry out the function of the drawing off of the air from the interior of the package to create a vacuum without injuring the contents within the package, such as the perishable items of meats, lettuce, tomatoes, broccoli, flowers, and the like. Attempts have been made to package meats by drawing off the air and creating a vacuum without causing the pressure that sucks out the blood from the meat and thereby causing the membranes to break down.

In the prior art is a United States patent to Kadunce, U.S. Pat. No. 4,471,900 whereby the construction of a circular tube with a completely different cap is shown. The Kadunce patent is an attempt at solving the problem of small packaging and does not solve the problems solved by the within inventor who has designed and conceived a package for carrying out the function to eliminate the problems herein described. The Kadunce patent is not an elaborate container, but has reinforced construction that renders the cost of the container extremely expensive, and therefore prohibitive for the uses herein intended. It also lacks the feature of informing the inspector of the package to determine whether or not the vacuum seal has been broken and air has infiltrated the contents of the package. It has no method of determining if it is a "leaker". Kadunce's package is also lacking in its ability to be stored and shipped in a convenient and simple manner as taught by the within invention.

There have been other attempts to create a package that are designed for the purpose of drawing off of the air and creating a vacuum which have not been successful and accepted in the marketplace. The packages have been vulnerable to damage and the vacuums and seals have broken without a method of ascertaining whether the vacuum has been broken and air has been admitted to the chamber and the contents consequently spoiled until after the package is opened. The prior packages have been difficult to handle and store during and after transit.

SUMMARY OF THE INVENTION

It is a principal object of the present invention to create a package with a substantially perfect vacuum environment in order to increase the shelf-life and appearance of the product being packaged and shipped, by means of a vacuum package of a rigid construction surrounded and circumscribed by a smooth thermoplastic bag.

Another object of this invention, is the creation of a crush proof container assembly with a thermo plastic overwrap so that the contents of the package are not under mechanical stress created by the bag collapsing when the air is drawn out and the vacuum is created.

It is yet another object of the within invention to provide an overwrap covering the crush proof package and thereby creating an improved vacuum.

It is yet a further object of the within invention to provide an improved vacuum package with non-moisture absorbing molecular sieves or absorbent materials which will control the effluents produced by perishable foods and flowers.

It is an additional object of the within invention to provide a package assembly that will reduce the respiration rate of perishable foods and flowers, by enclosing them in a vacuum environment whereby the molecular sieves or absorbent materials will establish an environment for prolonging the shelf-life of the contents.

It is a further object of the within invention to provide a package assembly for vacuum packaging fruits, vegetables, flowers and the like that will increase the normal shelf-life from two to six times the life of the contents under atmospheric and refrigerated conditions.

It is an additional object of the within invention to provide a package for vacuum packaging that will make it less expensive to ship perishable foods to various destinations and relieve the necessity of freezing the items that are to be packaged and also, permit the packaging of the items that cannot be frozen, but that can be vacuum packed and extend the shelf-life of said items.

Since perishable foods ripen under conditions of exposure to atmospheric air and temperatures above freezing and at normal room temperatures, spoilage, in most instances, occurs within 30 days of harvesting so that perishable foods would not be marketable and saleable where there is delayed delivery to the market.

It is therefore, an additional object of the within invention to provide a tubular container, preferably cylindrical in shape, and of a strong material, with a gas permeable flexing overwrap film in which plants, foods or flowers maay be enclosed. The container which is preferably cylindrical, because this is the best design for strength and rigidity, is vacuumized and may be stored under refrigerated conditions. Once the vacuum has been created it is not necessary to continue to expend energy by cooling and refrigerating the package, although, the best results are obtained if the package is maintained in a refrigerated and cool environment. The package does not have to be frozen, resulting in a substantial saving of energy and obviously a reduction in financial expenditure to bring the product to the marketplace.

It is an additional object of the within invention to produce a storage pack for plant, foods and flowers under vacuum, neutralizing the effluents produced by them and maintaining a relative humidity of 95%. These conditions will be maintained endogenously, rather than exogenously, portably, and after sealing, and not connected to outside power or energy sources.

It is yet a further additional object of the within invention to provide a vacuum packaging system that improves over the disadvantage of pouch-type vacuuming, where the vacuum frequently is subject to what is known in the trade as a leaker. It is almost impossible to detect without careful examination the loss of the vacuum.

The within invention provides for solving this problem by having a mechanical arrangement that is simple, inexpensive and permits the viewer to know whether or not the thermo plastic seal has leaked or has maintained its vacuum seal.

These and other objects are obtained by a cylindrical tubular member made from a paper fibre base material in a mold type circular unit. At each end of the tube, there is a cover with an opening. There is an end plate over each end of the package with an opening therein. Behind the opening within the thermo plastic film covering the tube, there is a colored disc. The disc is preferably green. Painted on the seal surface of an end of the container is a red spot. The thermo-plastic film is vacuumized as is the contents within the tubular container. In the event that the vacuum is broken, the green disc at the end of the package will drop down, away from the red spot on the surface of the end seal of the package and this will signal to the user that the environment is no longer a vacuum, but a leaker.

In order to facilitate the storing and shipping of the device, there are at each end of the finished package square end plates which not only act as bumpers to prevent the destruction by weight or abuse to the cylindrical package, but also, enable same to stand erect on its ends or be placed one on top of the other for storage during transit and/or for storing during the shelf-time, waiting for the consumer to purchase and/or use.

BRIEF DESCRIPTION OF THE DRAWINGS

These and other objects may be determined and ascertained from the invention by reference to the detailed description of the drawings in which:

FIG. 1 is a cross section view of the cylindrical tube shown in the view of FIG. 11.

FIG. 2 is an elevational view of the cylindrical tube partially in cross-section.

FIG. 3 is a top plan view of the cover of the cylindrical tube.

FIG. 4 is a cross section view of the cover along line 4—4 of FIG. 3.

FIG. 5 is a top plan view of the end support plate of the packaging unit shown in the view of FIG. 11.

FIG. 6 is a sectional view taking along line 6—6 of the view of FIG. 5.

FIG. 7 is a diagramatic view of the cylindrical tube being inserted into the transparent thermo plastic bag that is to be vacuumized.

Figure 8:
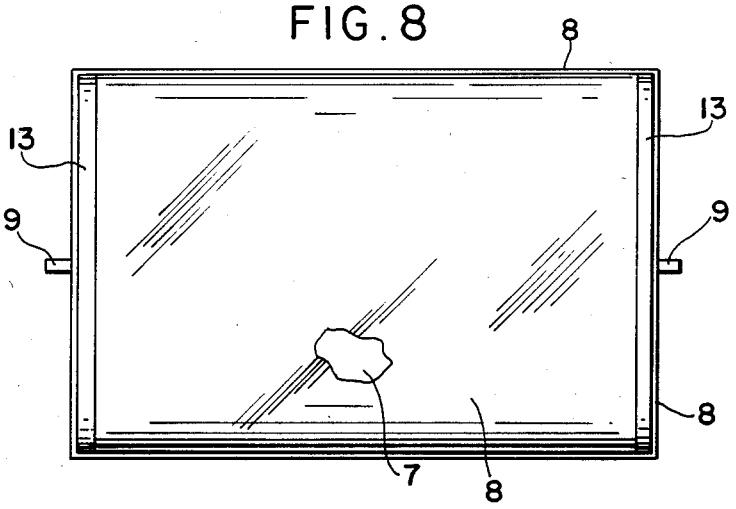
FIG. 8 is a side elevational view of the transparent thermo plastic bag, now vacuumized, in position over the tube with a sealing clip secured to each end of the thermo plastic bag.

The cylindrical tube 7 is made up of a spiral composite fiber or convolute inner surface 1 which has an inside moisture proof coating of wax or plastic 2. This coating 2 is also placed on the outside surface 4 over the spiral composite fiber or convolute material 1. There are four openings 3 in the cover 13. The cover 13 is made of the same material and construction as the walls of the tube 7. Cover 13 is located at the top and bottom ends of the tube 7, shown in FIG. 2. There is a red disc 14 painted on the center of the cover 13. The inside surface of the cover 13 is made of a material 12 similar to the cylinder 7 on the top and bottom cover 11. The construction is as stated similar to the construction of the inner surface 1 and outer surface 4 of the tube 7. There is a peripheral recess or shoulder 18 whereby the cover 13 is seated into position over the ends of the tube 7 as shown in FIG. 2.

The end plate 5 (FIGS. 5 and 6) is made of a styrofoam or rubber or a resilient material. End plate 5 is a square block, having flat surfaces 16, so that it will facilitate storage not only during transit, but also shelf storage. The flat surface 16 and has sufficient surface area so that it will act as a support member. There is an opening 15 in the end plate 5. Behind the opening 15 is located the green disc 10 which covers the red spot 14 and is located within the transparent thermo plastic bag 8 which surrounds the tube 7 as shown in the views of FIGS. 7 and 8.

The transparent thermo plastic bag 8 is sealed mechanically by the clips 9 which are conventional for sealing thermo plastic bags. The finished package which maintains the end plates 5 positioned over each end of the cylindrical tube 7 in the thermo plastic bag 8 are held together by the bands 17 which can be seen in detail in the view of FIG. 11.

The top and bottom plates 13 of the tubes 7 are glued by an adhesive material 6 at their peripheral shoulder 18 to the top and bottom of the ends of surfaces 4 and 1 which is shown in detail in the view of FIG. 2.

The unit disclosed is assembled as further described. The bottom plate 13 is glued to the bottom of the tube 7 at the shoulder 18 by the cement 6 (or glue). Produce such as vegetables or fruit are placed within the tube. The top plate 13 is then glued or cemented onto the tube 7 in a similar fashion as shown in FIG. 2 so that the tube is now closed. The openings 3 are to permit the escape of air when the vacuum pumping takes place. The thermo-plastic seal, bag 8 is placed over the assembled tube 7 as shown in FIG. 7.

Before the clips 9 are placed on the transparent thermo plastic film 8, the air is pumped out of the tube 7 through the openings 3. The green disc 10 is placed over the red spot 14 at the end of the tube cover plate as shown at 10 prior to the final closure of the thermo plastic bag 8 taking place. The sealing clips 9 are then placed over the bag 8 having removed all of the air from within the tube 7 and from the bag 8. The end support plates 5 are then placed in position at each end of the tube 7 as shown in the view of FIGS. 9, 10 and 11.

Figure 9:
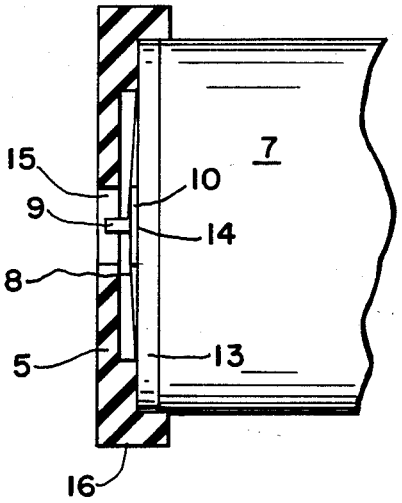
FIG. 9 is a diagramatic view, in section, similar to the view of FIG. 6, and showing the end of the thermo plastic bag with the green disc in position over the red spot on the cover with the square end support plate in position thereover.

The view of FIG. 9 shows the placing of the green disc 10 in position.

Figure 10:
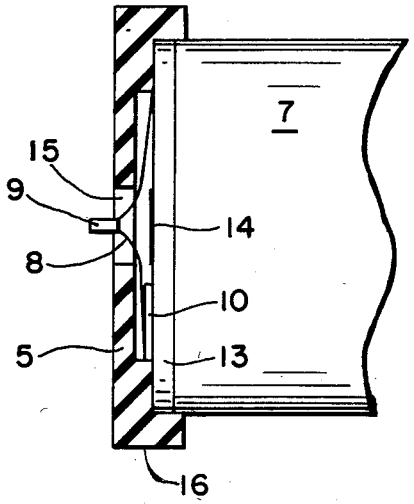
FIG. 10 is a view similar to FIG. 9 with the green disc out of position because of a leak in the vacuum package whereby the red spot appears through the opening in the end support plate.
Figure 11:
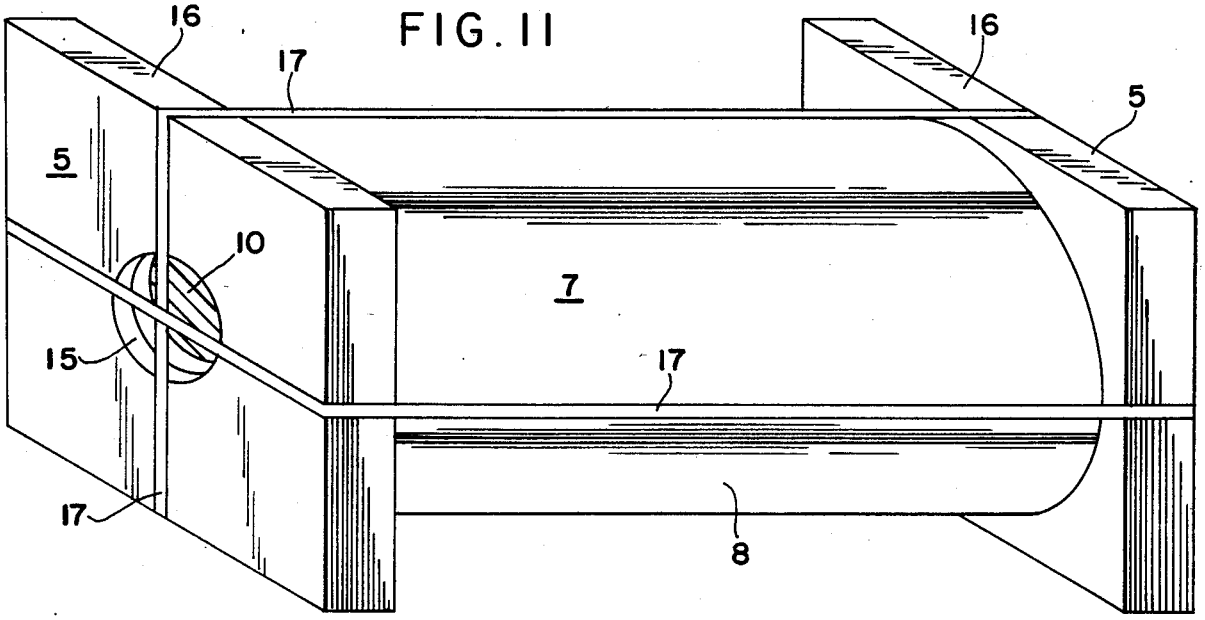
FIG. 11 is a perspective view of the assembled vacuum package cylindrical tubular unit with the shipping bands in position ready for shipment.

The view of FIG. 10 discloses how the signaling of the breaking of the seal takes place. Painted on the center of end cover 13 of the tube 7 is a red spot 14. Since the green disc 10 is sealed within the vacuum, it will remain snug covering the painted red spot 14 on the end surface of 13 and conceal it. Should the vacuum seal break and air enter into the package assembly, then the green disc 10 will drop down by force of gravity from its position and the red painted spot 14 will appear through the opening 15 in the cover plate 5, indicating that the vacuum seal has broken and the package is a "leaker"

The cylindrical tube 7 in combination with the film 8, lends itself to drawing an improved vacuum. The addition of non-moisture absorbing molecular sieves or absorbent materials (placed in the vacuum) creates an improved environment which will control gaseous effluents produced by perishable foods and flowers.

I claim:

1. A package for storing and shipping perishable items of produce, meats, and flowers, comprising of a tubular chamber substantially cylindrical in shape, cover plates, each adapted to fit over each end of the opening in said tubular chamber, means for securing said cover plates to the ends of the tubular chamber, a plurality of openings in the periphery of each of said cover plates, a painted red circular spot in the center area of each of said cover plates, a transparent plastic film designed to circumscribe said tubular member, a disc preferably green in color adapted to cover said red spot on said cover plate, mechanical sealing clips adapted to close each end of said plastic film after the air has been removed from said tubular chamber through said openings in the cover plates and the open ends of said plastic film whereby the contents within the tubular chamber is maintained under a vacuum seal excluding the outside atmosphere and air, and whereby the cylindrical wall of the tubular chamber prevents the contents therein from being crushed both while the air is drawn off to create the vacuum, and during storage and shipment.

2. A package for storing and shipping perishable items of produce, meats and flowers as described in claim 1 whereby when the seal of the film is caused to leak, the green disc covering the red spot on said cover plate will fall down within the plastic film enclosure and the red spot will appear through the transparent film at the end of the package, indicating that the vacuum has broken and air has leaked inside of the chamber.

3. A package as described in claim 1 having two end plates with flat surfaces, means for securing each of said end plates opposite to and adjacent to the said cover plates, an opening in at least one of said end plates whereby the area of the green disc may be observed through said opening, and whereby the said end plates enable the tubular member as assembled to be supported conveniently for storage and transit.

4. A package as described in claim 2 having two end plates with flat surfaces, means for securing each of said end plates opposite to and adjacent to the said cover plates, an opening in at least one of said end plates whereby the area of the green disc may be observed through said opening, and whereby the said end plates enable the tubular member as assembled to be supported conveniently for storage and transit.

5. A package as described in claim 3 whereby the means for securing each of said end plates opposite to and adjacent to the cover plates comprises a plurality of flat bands circumscribing the tubular chamber and covering each side of the end plate.

6. A package as described in claim 4 whereby the means for securing each of said end plates opposite to and adjacent to the cover plates comprises a plurality of flat bands circumscribing the tubular chamber and covering each side of the end plate.

7. A package as described in claim 3 whereby the end plates have at least four flat surfaces, each of said surfaces having sufficient area to permit same to act as a support, each of said end plates having a recess within its inner surface adapting it to complement the contour of the cover plates of said tubular chamber.

8. A package as described in claim 4 whereby the end plates have at least four flat surfaces, each of said surfaces having sufficient area to permit same to act as a support, each of said end plates having a recess within its inner surface, adapting it to complement the contour of the cover plates of said tubular chamber.

9. A package as described in claim 1 whereby the inner surfaces of the tubular chamber is covered with a moisture proof coating.

10. A package as described in claim 2 whereby the inner surfaces of the tubular chamber is covered with a moisture proof coating.

* * * * *